United States Patent [19]

Buhren et al.

[11] 4,254,518

[45] Mar. 10, 1981

[54] VACUUM MATTRESS, PREFERABLY FOR RESCUE VEHICLES

[75] Inventors: Wolfgang Buhren, Weissach; Rainer Hoefs, Schwieberdingen; Ulrich Bez, Gerlingen, all of Fed. Rep. of Germany

[73] Assignee: Dr. Ing. hc.F. Porsche Aktiengesellschaft, Stuttgart, Fed. Rep. of Germany

[21] Appl. No.: 51,748

[22] Filed: Jun. 25, 1979

[30] Foreign Application Priority Data

Jun. 23, 1978 [DE] Fed. Rep. of Germany ..... 2827589

[51] Int. Cl.[3] ..... A47C 27/10; A47C 21/08

[52] U.S. Cl. ..... 5/450; 5/455; 5/424

[58] Field of Search ..... 5/449, 450, 452, 453, 5/454, 455, 456, 465, 437, 424, 427, 431, 434, 436, 81 R, 82 R, 118, 441, 512

[56] References Cited

U.S. PATENT DOCUMENTS

| | | | |
|---|---|---|---|
| 807,360 | 12/1905 | Coyle | 5/427 |
| 3,608,961 | 9/1971 | Von Meck | 297/284 |
| 4,045,830 | 9/1977 | Loeb et al. | 297/284 |

FOREIGN PATENT DOCUMENTS

| | | | |
|---|---|---|---|
| 2318964 | 10/1974 | Fed. Rep. of Germany | 5/449 |
| 268 | of 1892 | United Kingdom | 5/82 |
| 1031814 | 6/1966 | United Kingdom | 5/436 |

*Primary Examiner*—Roy D. Frazier
*Assistant Examiner*—Alexander Grosz
*Attorney, Agent, or Firm*—Craig and Antonelli

[57] ABSTRACT

A vacuum mattress of the type having a casing that is loosely filled with a multitude of synthetic plastic components so as to enable the mattress to adapt in shape to the body contour of a person thereon and which is retained in the body contour adapted shape by evacuation of the casing, is provided with support elements projecting above an upper surface plane of a central mattress-forming element and have at least a portion thereof extending in a direction across at least one end thereof. In preferred embodiments, the support elements are formed by separate casings from that of the central element and these casings are evacuatable separately and/or jointly from each other, and the support elements are configured so as to define an opening for a person's head and support for his shoulders. The support element in the illustrated embodiments include either a ring segment shaped section for defining the head opening and shoulder support or segments extending diagonally and normally with respect to a central longitudinal plane of the mattress.

2 Claims, 3 Drawing Figures

VACUUM MATTRESS, PREFERABLY FOR RESCUE VEHICLES

BACKGROUND AND SUMMARY OF THE INVENTION

The invention relates to a vacuum mattress, primarily for rescue vehicles, said mattress comprising a skin filled with a plurality of parts made of plastic, for example, polystyrene, with a valve being provided for evacuating the mattress, whereby the mattress comprises a plurality of elements which can be evacuated separately and/or jointly, and by the fact that a central element is abutted by two lateral elements, the latter serving as rails and extending above the surface of the central element. A vacuum mattress of this type is disclosed in co-pending, commonly assigned U.S. application Ser. No. 010,996, filed Feb. 9, 1979.

The vacuum mattress cited hereinabove, by virtue of its design, can easily be used in conjunction with various types of injuries involving human beings. However, systematic studies of vehicles and vacuum mattresses with immobilized patients have revealed that under certain conditions under which the vehicle is decelerated, for example collision, braking, or the like, the vacuum mattress, whose longitudinal central plane is primarily aligned with the longitudinal direction of the vehicle, no longer offers a secure support for the patient.

Hence, an object of the invention is to provide arrangements on the vacuum mattress such that the patient is held in a protected position even when the vehicle is subjected to a deceleration, while retaining its ease of handling.

According to a preferred embodiment of the invention, this object is achieved by virtue of the fact that the elements comprise a support for body parts of the patient, for example shoulders, at at least one end of the vacuum mattress. It is advantageous in this connection for the support to be formed by the lateral elements, which run in a direction aligned with the longitudinal central plane. The arrangement of each lateral element, relative to the central longitudinal plane, comprises portions having a diagaonally directed section and a normal directed section. The lateral elements form an opening for the head area of the patient. Moreover, the central element is provided with local recesses for flush fitting of lateral elements.

The particular advantages of the invention include the fact that the mattress, aligned with the length of the vehicle, by supporting the injured person, provides a comfortable and safe support even when the vehicle decelerates. This support for the patient's shoulders (highly effective from the biomechanical standpoint) is provided in a simple fashion by the lateral elements.

These and further objects, features and advantages of the present invention will become more obvious from the following description when taken in connection with the accompanying drawings which show, for purposes of illustration only, several embodiments in accordance with the present invention.

BRIEF DESCRIPTION OF THE PREFERRED EMBODIMENTS

DETAILED DESCRIPTION OF THE PREFERRED EMBODIMENTS

Figure 1:
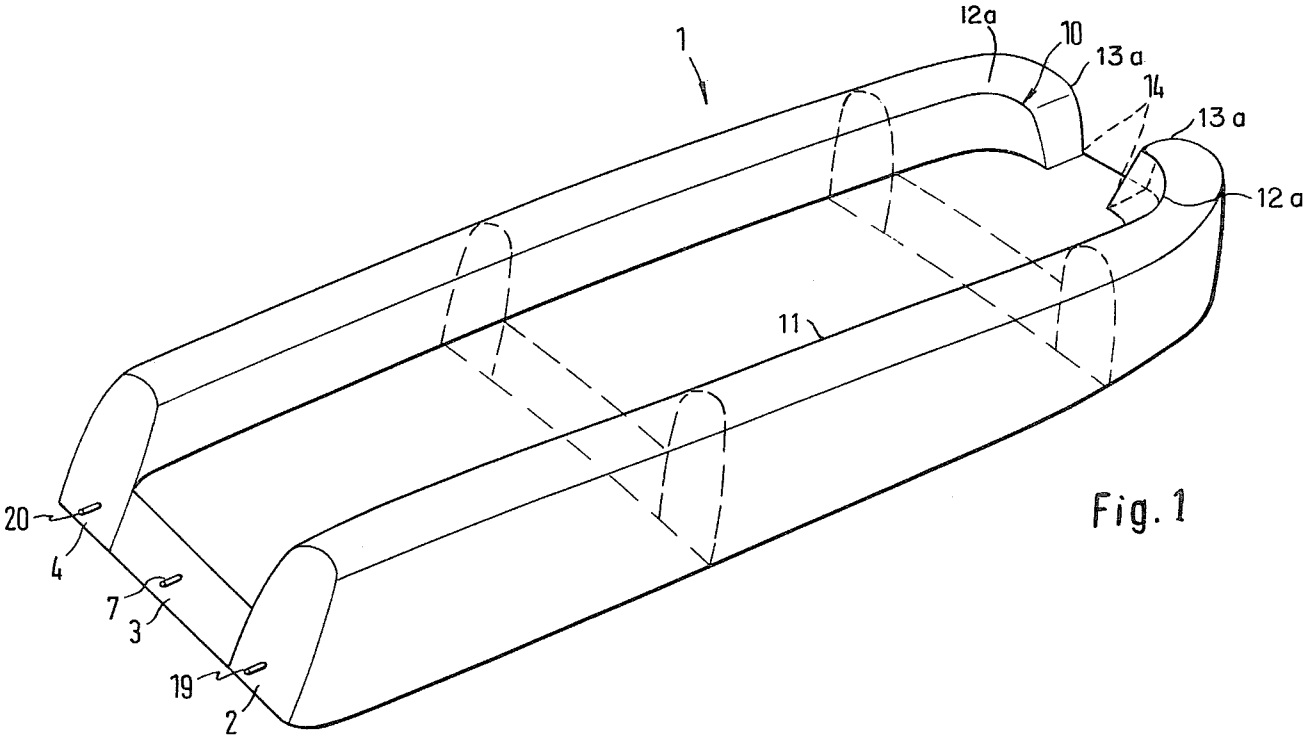
FIG. 1 is a three-quarters perspective view of the vacuum mattress according to the invention.

The preferred embodiments will now be discussed in detail with reference to the drawings wherein like elements common to both embodiments bear the same reference numerals and modified elements bear an "a" suffix.

Vacuum mattress 1 is formed by a plurality of elements 2, 3, and 4. Each element, e.g. element 3, comprises a skin 5, filled with particles 6 of plastic, for example polystyrene. Element 3 is provided with a valve 7 for evacuation.

In the embodiments shown, the middle element 3 is abutted by two lateral elements 2 and 4. Lateral elements 2 and 4 have sections 8 and 9 which project above the surface A of mattress 1, so that these segments serve as lateral supports for an injured person.

A support 10 is provided at one end of the vacuum mattress 1 for the patient's shoulders. Support 10 is formed by lateral elements 2 and 4, which have a length 11 which runs parallel to the longitudinal central plane A—A of mattress 1. In addition, elements 2 and 4, in the FIG. 2 embodiment, have a section 12 and a section 13 which are diagonal to and at right angles to, respectively, the longitudinal central plane A—A. However, the area formed by sections 12 and 13 can also be made in the form of ring segments 12*a*, 13*a* (FIG. 1).

Figure 2:
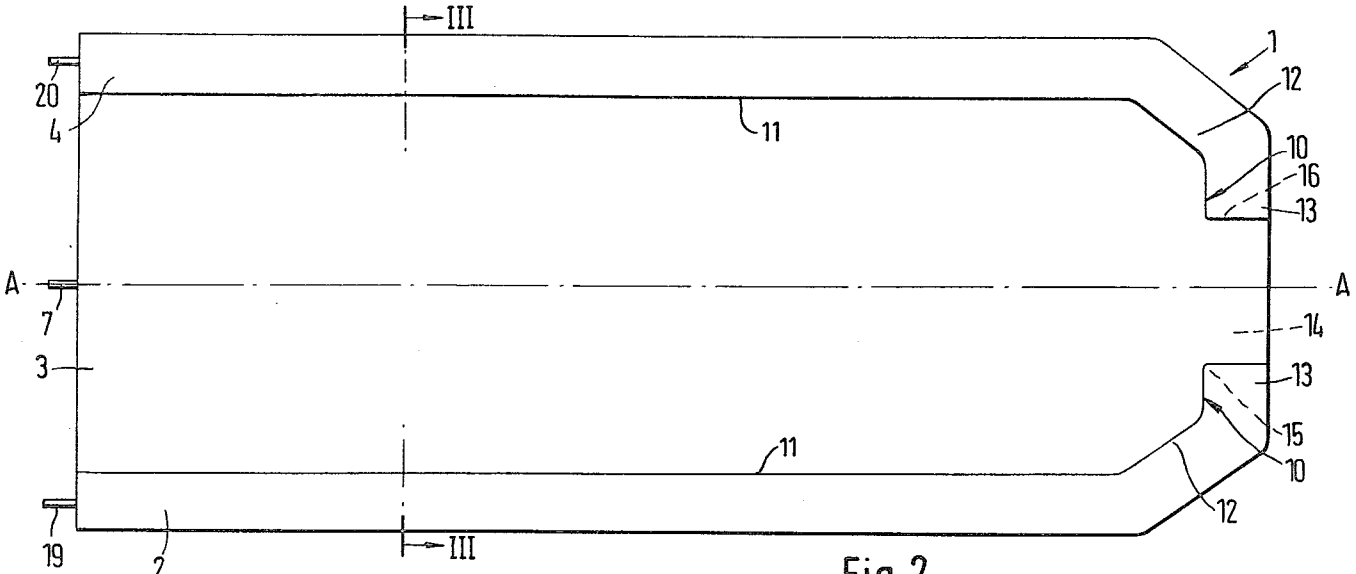
FIG. 2 is a top view of a modified vacuum mattress.

An opening 14 for the head area of the patient is provided between sections 13, 13*a* which form the support. The central element 3 is recessed at one end by the provision of cut-out areas 15 and 16 which, as shown in FIG. 2, dimensionally correspond to end sections 12 of the lateral elements 2 and 4, so that these end sections 12 can be located flush against the end face of central mattress element 3 and present a continuous end surface for mattress 1 in conjunction with the resultant, protecting central end portion of the central mattress element 3.

Figure 3:
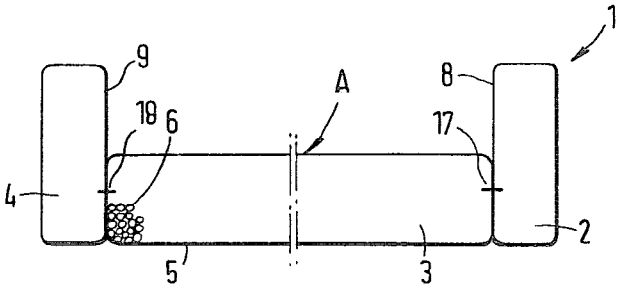
FIG. 3 is a cross section along 1 line III—III in FIG. 2.

Central valve 7, mounted on element 3, can be used to evacuate the mattress. Openings 17 and 18 (FIG. 3) are then provided between elements 2, 3, and 4. If desired, valves 19 and 20 can also be provided on elements 2 and 4, so that elements 2, 3, and 4 can be evacuated separately. A suitable valve construction as well as the manner of evacuation are described in the above-cited co-pending application, which application is hereby incorporated by reference to the extent necessary to complete an understanding hereof.

It is also contemplated that the lateral supports 2, 4 can be formed as part of central element 3 and/or additional elevated areas can also be provided on central element 3 to serve as a support for the patient.

While we have shown and described several embodiments in accordance with the present invention, it is understood that the same is not limited thereto but is susceptible of numerous changes and modifications as known to those skilled in the art and we therefore do not wish to be limited to the details shown and described herein but intend to cover all such changes and modifications as are encompassed by the scope of the appended claims.

We claim:

1. In a vacuum mattress of the type comprising a casing means loosely filled with a multitude of synthetic plastic components so as to enable the mattress to adapt in shape to the body contour of a person thereon, and means placed in the casing for evacuation thereof, the improvement wherein said casing means is comprised of a central horizontal mattress element and vertical support elements extending along the longitudinal sides of said central mattress element, wherein each support element has a ring segment shaped section for supporting a person's shoulders, wherein the support elements form an opening for the head area of a patient, and wherein said central element and support elements are formed by separate casings at least some of which are interconnected by valve means forming part of said means for evacuating said casing means and serving for separately or jointly evacuating said casings.

2. In a vacuum mattress for rescue vehicles of the type comprising a casing means loosely filled with a multitude of synthetic plastic components so as to enable the mattress to adapt in shape to the body contour of a person thereon, and means placed in the casing for evacuation thereof, the improvement wherein said casing means is comprised of a central horizontal mattress element and vertical support elements extending along the longitudinal sides of said central mattress element, said support elements projecting above an upper surface plane of the central element and having a body supporting portion extending in a direction across at least one end thereof, wherein each support element has a section which extends diagonally with respect to the central longitudinal plane of the mattress and a section which is at right angles to the longitudinal central plane, for supporting a person's shoulders, wherein the support elements form an opening for the head area of a patient, and wherein said central element and support elements are formed by separate casings at least some of which are interconnected by valve means forming part of said means for evacuating said casing means and serving for separately or jointly evacuating said casings.

* * * * *